US009339675B2

(12) United States Patent
Koiwa

(10) Patent No.: US 9,339,675 B2
(45) Date of Patent: May 17, 2016

(54) SPRINKLER HEAD

(75) Inventor: Yasuaki Koiwa, Tokyo (JP)

(73) Assignee: SENJU SPRINKLER CO., LTD., Tokyo (JP)

( * ) Notice: Subject to any disclaimer, the term of this patent is extended or adjusted under 35 U.S.C. 154(b) by 917 days.

(21) Appl. No.: 13/378,438

(22) PCT Filed: Apr. 6, 2010

(86) PCT No.: PCT/JP2010/056192

§ 371 (c)(1),
(2), (4) Date: Dec. 15, 2011

(87) PCT Pub. No.: WO2011/125169

PCT Pub. Date: Oct. 13, 2011

(65) Prior Publication Data

US 2012/0090859 A1 Apr. 19, 2012

(51) Int. Cl.
*A62C 37/08* (2006.01)
*A62C 37/11* (2006.01)

(52) U.S. Cl.
CPC ..... *A62C 37/11* (2013.01); *A62C 37/08* (2013.01)

(58) Field of Classification Search
CPC ..... A62C 37/08; A62C 37/11; A62C 37/12
USPC ..... 169/14, 37, 41
See application file for complete search history.

(56) References Cited

U.S. PATENT DOCUMENTS 5,117,916 A 6/1992 Ohta et al.
6,082,463 A * 7/2000 Ponte ..... 169/41
6,840,329 B2 * 1/2005 Kikuchi et al. ..... 169/37

(Continued)

FOREIGN PATENT DOCUMENTS

CN 2410043 Y 12/2000
JP 53-62798 U 5/1978
JP 56-49636 Y2 11/1981

(Continued)

OTHER PUBLICATIONS

International Search Report for PCT Patent App. No. PCT/JP2010/056192 (Jun. 22, 2010).

(Continued)

*Primary Examiner* — Arthur O Hall
*Assistant Examiner* — Viet Le
(74) *Attorney, Agent, or Firm* — Cermak Nakajima & McGowan LLP; Tomoko Nakajima

(57) ABSTRACT

A sprinkler head A has a main body including a pipe connection portion and a frame portion. In the frame portion, an outer circumferential surface protruding to the outside of the pipe connection portion is provided, and beam-like portions (inward flanges) with which a lever of a thermo-sensitive breakup portion engages and openings obtained by cutting off the outer circumferential surface from the side of the pipe connection portion to the beam-like portion are provided at opposite positions in the outer circumferential surface. Thereby, the weight of the frame portion can be largely reduced. Therefore, the weight of a sprinkler head is reduced, so that the weight load applied to the fire extinguishing system pipes in which a large number of sprinkler heads are installed can be reduced, and the work burden due to the weight load when the sprinkler heads are conveyed and installed in the fire extinguishing system pipes can also be reduced.

20 Claims, 11 Drawing Sheets

(56) References Cited

U.S. PATENT DOCUMENTS

| | | | | |
|---|---|---|---|---|
| 7,275,603 | B2 * | 10/2007 | Polan | 169/37 |
| 2008/0115948 | A1 * | 5/2008 | Koiwa | 169/38 |

FOREIGN PATENT DOCUMENTS

| | | | |
|---|---|---|---|
| JP | 1-59158 | U | 4/1989 |
| JP | 04-212382 | A | 8/1992 |
| JP | 06-039030 | U | 5/1994 |
| JP | 07-284545 | A | 10/1995 |
| JP | 2001-299955 | A | 10/2001 |
| JP | 2003-275336 | A | 9/2003 |
| JP | 2003-339901 | A | 12/2003 |
| JP | 2008-154697 | A | 7/2008 |
| JP | 2008-212384 | A | 9/2008 |
| JP | 2008-264021 | A | 11/2008 |
| JP | 2009-291359 | A | 12/2009 |

OTHER PUBLICATIONS

Office Action from Chinese Patent App. No. 201080033198.3 (Aug. 20, 2014).

* cited by examiner

PRIOR ART

SPRINKLER HEAD

This application is a national phase entry under 35 U.S.C. §371 of PCT Patent Application No. PCT/JP2010/056192, filed on Apr. 6, 2010, which is incorporated by reference.

TECHNICAL FIELD

The present invention relates to a fire extinguishing sprinkler head.

BACKGROUND ART

A sprinkler head is installed on a ceiling surface or a wall surface in a building and provided with a nozzle that can be coupled to a pipe connected to a water source at one end and a thermo-sensitive actuator at the other end. In a normal condition, the thermo-sensitive actuator supports a valve body that closes the nozzle.

As a conventional sprinkler head, a sprinkler head of FIG. 13 is known (PTL 1). The sprinkler head 50 has a structure in which a pipe connection portion 51 and a frame 52 are screwed together by a screw 51A. When the pipe connection portion 51 and the frame 52 are screwed together, a lever 55 engaged with an inward flange 52A located at the lower end of the frame 52 and a saddle S are displaced toward the pipe connection portion 51 and a valve body 54 pressed by the displaced saddle S is closely attached to a nozzle end 53, so that the nozzle end 53 is blocked.

A slit-shaped opening 52B is formed over the inward flange 52A with which the lever 55 engage. The opening 52B is formed, so that a beam-like portion 52C is formed in the frame 52 under the opening 52B, and the inward flange 52A including a step portion is formed on an inner circumference of the beam-like portion 52C. The lever 55 is engaged with the inward flange 52A, so that, when a load is added to the beam-like portion 52C in a position opposite to the opening 52B (downward direction in FIG. 12), a deflection occurs and resilience is obtained. In other words, when the pipe connection portion 51 and the frame 52 are screwed together, a deflection occurs in the beam-like portion 52C by the lever 55 disposed under the opening 52B, and the deflection causes a spring force. The spring force has a function to explosively eject components of a thermo-sensitive breakup portion 57 to the outside of the sprinkler head 50 when the sprinkler head is actuated, so the spring force is useful for preventing a lodgment (clog of components of the thermo-sensitive breakup portion 57 when a breakup occurs).

CITATION LIST

Patent Literature

Patent Document 1: Japanese Unexamined Patent Application Publication No. 7-284545

Patent Document 2: Japanese Examined Utility Model Registration Application Publication No. 56-49636

SUMMARY OF INVENTION

Problem to be Solved by the Invention

In the sprinkler head 50 as described above, the pipe connection portion 51 and the frame 52 are forged parts and heavy, so that it is required to reduce the weight thereof. In fire extinguishing system pipes laid down over a ceiling or the like, generally, many sprinkler heads 50 are installed. Therefore, if the sprinkler head 50 is heavy, the weight of the entire fire extinguishing system becomes heavy, so that many support metal fittings are required to be used to support the weight. Thus there is a problem that the entire system cost increases. Although a metal pipe has been mainly used as a fire extinguishing system pipe, in recent years, a resin pipe, which is inexpensive and light weight and has a good constructability by a header construction method (see Japanese Unexamined Patent Application Publication No. 10-52512 as an example of the method), is also used instead of the metal pipe. Therefore, to reduce the weight load applied to the resin pipe as much as possible for a long period of time, it is desired that the sprinkler head 50 connected to the resin pipe is further lightened.

The present invention is made in view of the conventional technique as described above. The object of the present invention is to lighten the sprinkler head.

Means for Solving the Problem

In order to solve the above problem, the present invention provides a sprinkler head described below.

The present invention provides a sprinkler head characterized by including a pipe connection portion, one end of which is connected to a fire extinguishing system pipe and the other end of which has a water outlet, a cylindrical frame portion, one end of which is connected to the water outlet and the other end of which has an opening end, and a thermo-sensitive breakup portion which holds a pressing force of a valve body closing the water outlet and has a lever to which a reaction force of the pressing force is applied. The frame portion has an outer circumferential surface protruding outside of the pipe connection portion, and the frame portion has beam-like portions with which the lever is engaged and opening portions obtained by cutting off the outer circumferential surface from the side of the pipe connection portion to the beam-like portion at opposite positions in the outer circumferential surface.

The frame portion of the present invention has the outer circumferential surface protruding outside of the pipe connection portion and includes the beam-like portions with which the lever is engaged and the opening portions obtained by cutting off the outer circumferential surface from the side of the pipe connection portion to the beam-like portion at opposite positions in the outer circumferential surface. Thereby, in the present invention, the weight of the frame portion can be largely reduced. Therefore, the load applied to the fire extinguishing system pipe can be reduced, and the work burden due to the weight load when the sprinkler heads are conveyed and installed in the fire extinguishing system pipes can also be reduced.

The beam-like portions are located at opposite positions, so the press load of the lever of thermo-sensitive breakup portion can be equally applied to each beam-like portion and spring forces caused by deflection of each beam-like portion can be equally generated. Therefore, the thermo-sensitive breakup portion can be continuously and stably maintained over a number of years. The equal spring forces caused by deflection of each beam-like portion can explosively eject the components of the thermo-sensitive breakup portion in the axis direction of the frame portion when the thermo-sensitive breakup portion 4 is activated to break up, so that the equal spring forces can function to prevent the lodgment from occurring. Two or more pairs of beam-like portions and opening portions may be formed in opposite positions instead of one pair of those.

The above-described present invention can be configured so that the thermo-sensitive breakup portion can be inserted from the opening end of the frame portion.

Thereby, the thermo-sensitive breakup portion can be inserted from the opening end of the frame portion, so that the thermo-sensitive breakup portion can be easily installed inside the frame portion.

In this case, if the thermo-sensitive breakup portion is a unit component, the thermo-sensitive breakup portion can be inserted as a unit component from the opening end of the frame portion, so that the assembly operation can be simplified.

In the above-described present invention, the opening portion can be provided at an inner position nearer to a central axis of the frame portion than an outer circumferential surface of the beam-like portion.

To form the slit-shaped opening 52B in the frame 52 in the conventional technique, not only a process for cutting the inner circumferential surface and the outer circumferential surface of the frame 52, but also a dedicated process including a complex cutting operation by a large machining center is required. However, if the opening 52B can be formed without depending on such a dedicated process, the manufacturing cost can be reduced not only as a single component, but also as the entire sprinkler head 50.

Therefore, in the present invention, the opening portion is provided at an inner position nearer to the central axis of the frame portion than the outer circumferential surface of the beam-like portion. Thereby, the opening portion can be formed at the same time when the inner circumferential surface of the beam-like portion is cut, so that it is possible to reduce the manufacturing cost for forming the opening portion and providing the beam-like portion without depending on a dedicated process for forming the opening portion.

In the above-described present invention, the pipe connection portion and the frame portion can be a forged body having an integrated structure.

Thereby, the number of components can be reduced compared with a case in which the pipe connection portion and the frame portion are separate components. Therefore, the cost can be reduced.

In the above-described present invention, the thermo-sensitive breakup portion can be a unit component in which a plurality of components are combined.

According to the present invention, it is not necessary to mount the components of the thermo-sensitive breakup portion one by one, so that the assembly process can be simplified and the manufacturing cost can be reduced. The handling of the thermo-sensitive breakup portion during the assembly operation is also good because the thermo-sensitive breakup portion is a unit component.

In the above-described present invention, a lever engaging portion engaged with the lever of the thermo-sensitive breakup portion can be provided on the inner circumferential surface of the beam-like portion.

Thereby, the thermo-sensitive breakup portion can be installed inside the frame portion. To engage the thermo-sensitive breakup portion with the lever engaging portion, when using a thermo-sensitive breakup portion including a link in which two thin plates are connected together by a low melting point alloy and a pair of levers with which the link is engaged, the thermo-sensitive breakup portion can be mounted on the lever engaging portion while one end of the lever is engaged with the lever engaging portion and the other end is engaged with the link. When the thermo-sensitive breakup portion is the above-described unit component, the lever only has to be engaged with the lever engaging portion on the inner circumferential surface of the frame portion, so that the thermo-sensitive breakup portion can be easily mounted.

In the above-described present invention, a lever insertion groove that causes the lever of the thermo-sensitive breakup portion to be inserted in the frame portion can be provided on the inner circumferential surface of the frame portion.

Thereby, when the thermo-sensitive breakup portion is inserted into the frame portion, the lever engaging portion does not interfere with the thermo-sensitive breakup portion, so that the thermo-sensitive breakup portion can be easily inserted with good operability.

The thermo-sensitive breakup portion can be configured so that the thermo-sensitive breakup portion is inserted into the frame portion when the lever is inserted into the lever insertion groove and the lever is engaged with the lever engaging portion when the thermo-sensitive breakup portion is rotated around the axis of the frame portion. Thereby, when the thermo-sensitive breakup portion is rotated, the lever is engaged with the lever engaging portion, so that the assembly operation can be easily performed.

For example, the lever insertion groove as described above can be formed at a position rotated about 20° to 90° from the lever engaging portion.

In the above-described present invention, a deflector can be provided outside of the opening end of the frame portion.

Thereby, a deflector having a shape according to specification and usage of the sprinkler head can be placed outside the frame portion, so that many types of sprinkler heads in which the pipe connection portion, the frame portion, and the thermo-sensitive breakup portion are used in common can be developed.

In the above-described present invention, a deflector engaging portion that holds a deflector can be provided on the outer circumferential surface of the frame portion.

Thereby, a deflector having a shape according to specification and usage of the sprinkler head can be placed outside the frame portion, so that many types of sprinkler heads in which the pipe connection portion, the frame portion, and the thermo-sensitive breakup portion are used in common can be developed.

In the above-described present invention, a guide pin, one end of which is provided with a deflector and the other end of which is engaged with a deflector engaging portion provided on the frame portion, can be provided.

Thereby, the deflector can be reliably activated by a simple configuration using a guide pin.

In the above-described present invention, the deflector engaging portion can be provided on the outer circumferential surface of the frame portion in an outward position of the lever insertion groove.

Thereby, the position of the lever of the thermo-sensitive breakup portion is separated from the deflector engaging portion, so that the lodgment can be effectively prevented when the thermo-sensitive breakup portion is activated to break up. In other words, the lever insertion groove is located on the inner circumferential surface of the frame portion at which the deflector engaging portion is provided, so that the lever of the thermo-sensitive breakup portion cannot be engaged there. Therefore, the lever is engaged with the lever engaging portion located away from the deflector engaging portion. Thereby, in the present invention, it is possible to prevent the lever from hitting the guide pin when the thermo-sensitive breakup portion is activated to break up and lever flies and drops when the sprinkler head is activated, so that the lodgment can be prevented when the thermo-sensitive breakup portion is activated to break up.

In the above-described present invention, the deflector engaging portion can be provided nearer the opening end of the frame portion than the lever engaging portion.

Thereby, for example, the sprinkler head can be configured as a frame yoke type sprinkler head in which the deflector engaging portion is extended in a water discharge direction of the water outlet and the deflector is provided at the tip of the extended deflector engaging portion. In this case, the deflector engaging portion (arm) can be configured as a part of the frame portion, and also the deflector engaging portion (arm) can be configured as a member separate from the frame portion.

In the case of a concealed type sprinkler head, components other than a cover plate are arranged over the ceiling, and when a fire occurs, the deflector slides and protrudes from the lower surface of the ceiling and then water is sprinkled. To obtain a correct water sprinkling distribution performance, it is preferred that the deflector is protruded as much as possible from the lower surface of the ceiling. To increase the amount of the protrusion, the length of the guide pin that holds the deflector is increased or the stroke of the guide pin is increased. However, there is a problem that the manufacturing cost increases. Therefore, as described in the present invention, as a configuration in which the deflector engaging portion is provided nearer to the opening end of the frame portion than the lever engaging portion, the deflector engage portion is located nearer to the ceiling surface as much as possible, so that the amount of the protrusion of the deflector from the ceiling surface can be increased without depending on the lengthening of the guide pin or the stroke of the guide pin. The amount of the protrusion of the deflector from the ceiling surface, that is, a range of movement of the deflector, can be large, so that, even when there is a construction difference between the connection port of the fire extinguishing system pipe and the ceiling surface, the difference can be absorbed if the difference is within the range of movement of the deflector, and an attachment adjustment range of a concealed type sprinkler head can be enlarged when the sprinkler head is installed. Therefore, the installation is easily performed.

The above-described present invention can include a load generation member which is placed between the valve body and the thermo-sensitive breakup portion, urges the valve body and the lever of the thermo-sensitive breakup portion engaged with the beam-like portion in opposite directions from each other, and generates a press load for the valve body to block the water outlet.

More specifically, the above-described present invention can include, as the load generation member, a saddle which includes a compression screw pressing the valve body to the water outlet and a female screw that can be screwed with the compression screw, urges the thermo-sensitive breakup portion in a direction opposite to the pressing direction of the valve body to the water outlet by screwing the compression screw with the female screw, and engages the lever of the thermo-sensitive breakup portion with the beam-like portion in a pressing state.

Thereby, the valve body and the thermo-sensitive breakup portion are urged in a separating direction by screwing the compression screw with the female screw of the saddle, so that a pressing force of the valve body to the water outlet and a deflective deformation of the beam-like portion caused by the lever of the thermo-sensitive breakup portion can be generated. By such a simple component configuration and a simple assembly operation, a load necessary for water block performance of the valve body and deflective deformation of the beam-like portion can be obtained.

In the above-described present invention, a through-hole is provided in the thermo-sensitive breakup portion and an amount of screwing of the compression screw with the female screw of the saddle can be adjusted by a tool inserted into the through-hole.

Thereby, the assembly operation is completed by inputting all the components such as the valve body into the frame portion, and then adjusting the amount of screwing of the compression screw by a tool inserted through the through-hole of the thermo-sensitive breakup portion. Therefore, the assembly operation can be easily performed.

In the above-described present invention, a support cup having a cylindrical shape and a bottom portion, which accommodates the frame portion, can be provided in a main body including the pipe connection portion and the frame portion.

Thereby, it is possible to configure a concealed type sprinkler head that is buried and installed in a ceiling and a flush type sprinkler head in which the deflector is normally held near a ceiling and the deflector protrudes from the ceiling and sprinkles water when being activated.

The above-described present invention can be configured so that the main body and the support cup are connected to each other by a polygonal connection portion.

Thereby, the main body and the support cup are solidly connected to each other so that the main body and the support do not cause simultaneous bolt-nut rotation.

The above-described present invention can be configured to include a cover plate that covers over the sprinkler head installed in an opening in a ceiling so that the sprinkler head is not exposed to the outside and a cylindrical retainer that holds the cover plate as well as the support cup.

Thereby, the present invention can be implemented as a concealed type sprinkler head which covers over and hides the sprinkler head and the hole through which the sprinkler head penetrates so as not to spoil the beauty of the room.

Further, the above-described present invention can be configured to include a screwing groove on the outer circumferential surface of the support cup and an engaging portion which engages with the screwing groove on the retainer. Thereby, the support cup and the retainer can be easily connected to each other by screwing.

The above-described present invention can be configured to include a ceiling plate that covers over a boundary between an outer circumferential surface of the sprinkler head installed in an opening in a ceiling and an edge of the opening and a cylindrical retainer that holds the ceiling plate as well as the support cup.

Thereby, the present invention can be implemented as a flush type sprinkler head with a ceiling plate, which covers over and hides the sprinkler head and the hole through which the sprinkler head penetrates so as not to spoil the beauty of the room.

Further, the above-described present invention can be configured to include a screwing groove on the outer circumferential surface of the support cup and an engaging portion which engages with the screwing groove on the retainer. Thereby, the support cup and the retainer can be easily connected to each other by screwing.

The above-described present invention can be configured to include a cross-sectional U-shaped arm including an attaching portion for the outer circumferential surface of the frame portion at the upper end thereof and a deflector at the lower end thereof.

Thereby, the present invention can be configured as a frame type sprinkler head.

Advantageous Effects of Invention

According to the sprinkler head of the present invention, the sprinkler head can be lightened, so that the weight load applied to the fire extinguishing system pipes can be reduced. This contributes to reduction of the weight of the fire extinguishing system pipes, so that use of the support metal fittings of the pipes can be reduced and the system cost can be reduced. Further, the aging degradation of the resin pipes used instead of the metal pipes as the fire extinguishing system pipes can be suppressed. Furthermore, the work burden due to the weight load when the sprinkler heads are conveyed and installed in the fire extinguishing system pipes can be reduced.

BEST MODES FOR CARRYING OUT THE INVENTION

First Embodiment

FIGS. 1 to 9

Figure 1:
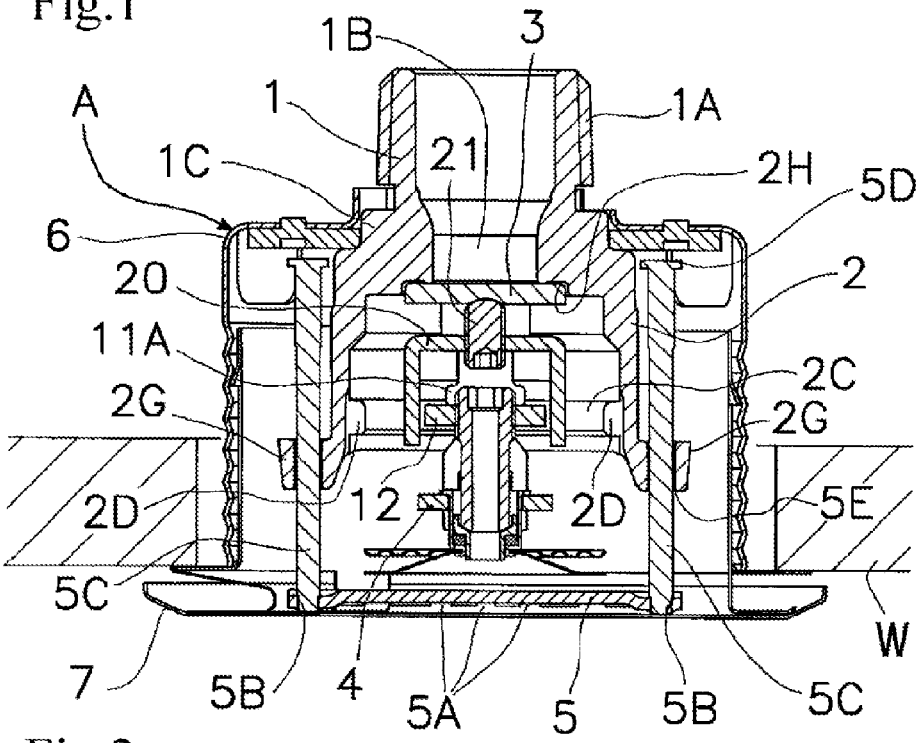
FIG. 1 is a cross-sectional view of a sprinkler head according to a first embodiment.

Hereinafter, a first embodiment of a sprinkler head of the present invention will be described with reference to FIGS. 1 to 9.

A sprinkler head A of the first embodiment includes a main body 1, a valve body 3, a thermo-sensitive breakup portion 4, a deflector 5, a support cup 6, and a cover plate 7. The sprinkler head A is configured as a concealed type sprinkler head.

Figure 2:
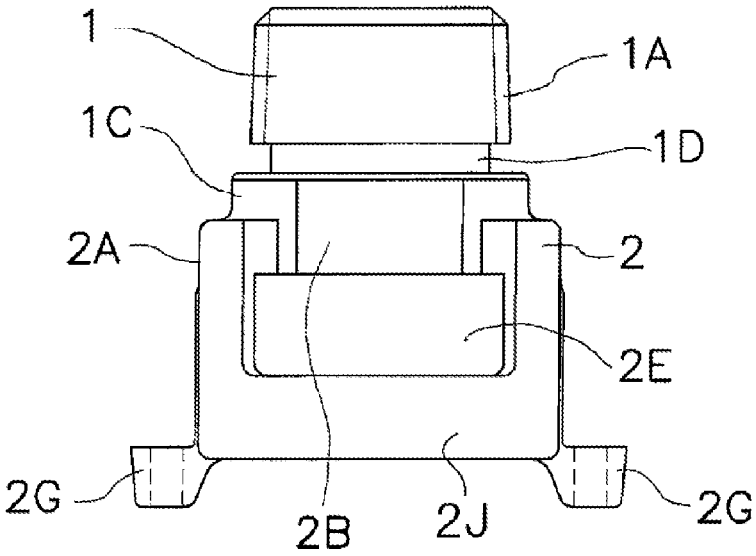
FIG. 2 is a front view of the sprinkler head of FIG. 1.
Figure 3:
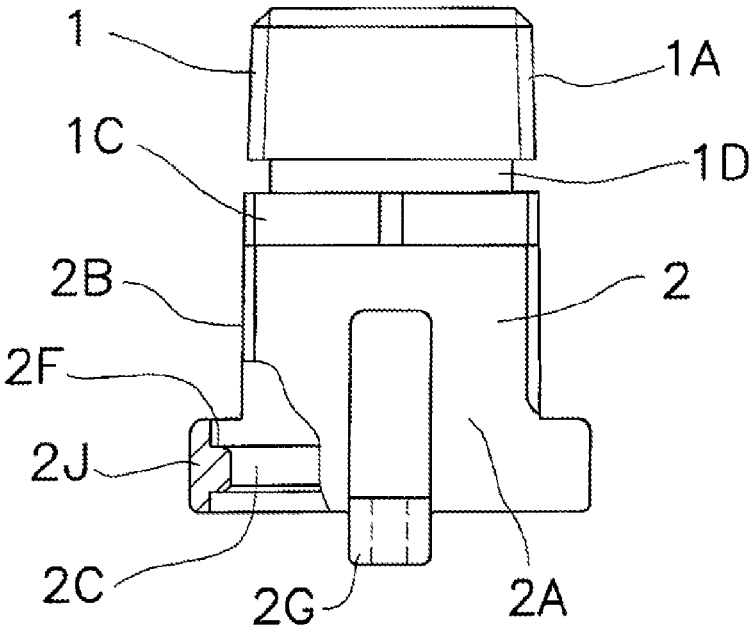
FIG. 3 is a side view of FIG. 2.

The main body 1 shown in FIGS. 1 to 3 has a hollow shape. One end of the main body 1 is a pipe connection portion 1A on which a male screw is formed, which can be connected to a pipe filled with water. The other end of the pipe connection portion 1A is a water outlet 1B. The end of the water outlet 1B is blocked by the valve body 3.

A support cup engaging portion 1C, whose outer circumference has a polygonal cross-sectional shape, is formed between the pipe connection portion 1A and the water outlet 1B. A flange portion having an outer circumference larger than that of the support cup engaging portion 1C is formed on the water outlet side 1B of the support cup engaging portion 1C, and a cylindrical frame portion 2 is formed from the edge of the flange portion toward a water discharge side. The main body 1 includes the pipe connection portion 1A and the frame portion 2 having an outer circumference surface larger than that of the pipe connection portion 1A.

The horizontal cross-sectional shape of the outer circumference of the frame portion 2 has a shape obtained by cutting off two portions of a circle in parallel. Specifically, two straight line segments from which the two portions are cut off and arc segments between the straight line segments are formed. Therefore, on the outer circumference surface of the frame portion 2, curved surface portions 2A having a circular-arc cross-sectional shape and planar surface portions 2B having a linear cross-sectional shape are formed. The planar surface portion 2B is formed as a cut-off surface portion formed by cutting off the outer circumference of the frame 2 from the side facing the pipe connection portion 1A to a beam-like portion 2J described later, and an opening 2E is formed there. The cross-sectional shape of the outer circumference of a lower portion of the frame 2 is a circle which does not include the planar surface portions 2B and has the same radius as that of the curved surface portions 2A. Specifically, the beam-like portions 2J, which are made of an arc-shaped portion provided along the circumferential direction of the frame 2, are formed under the planar surface portions 2B. The beam-like portions 2J are formed in opposite positions around the cylinder axis of the frame portion 2.

An inward flanges 2C, which are formed to extend inwardly, are formed on a lower inner circumference of the frame portion 2 (inner circumference surfaces of lower portions of the curved surface portions 2A and inner circumference surfaces of the beam-like portions 2J). Lever insertion grooves 2D and 2D are formed on the inward flanges 2C located at lower portions of the curved surface portions 2A (FIG. 1).

The opening 2E is formed in the planar surface portion 2B of the frame portion 2 rotated substantially 90° from the lever insertion groove 2D. The opening 2E is formed by boring the inside of the frame portion 2 by a diameter smaller than the outside diameter of the curved surface portion 2A and larger than the distance between the two planar surface portions 2B.

The inward flange 2C of the beam-like portion 2J located under the opening 2E becomes a lever engaging portion 2F with which a lever 11 of the thermo-sensitive breakup portion 4 described later engages. The lever engaging portion 2F is provided on the beam-like portion 2J under the opening 2E, so that, when a load is applied to the lever engaging portion 2F in a direction from the water outlet 1B to the lower end of the frame portion 2, the beam-like portion 2J is elastically deformed by the applied load, and the amount of deformation of the beam-like portion 2J due to the elastic deformation can be larger than that in a case in which the opening 2E is not provided. The elastic deformation (deflection) of the beam-like portion 2J generates a spring force. The spring force has a function to explosively eject components of the thermo-sensitive breakup portion 4 to the outside when the sprinkler head A is actuated, and the spring force functions to prevent a lodgment from occurring.

A deflector engaging portion 2G, which is formed downward from the lower end of the frame portion 2, is formed on the outer circumference of the lever insertion groove 2D. A step portion 2H, which can accommodate the valve body 3, is formed at the boundary between the frame portion 2 and the water outlet 1B. A movement of the valve body 3 when the valve body 3 is shifted from the water outlet 1B by vibration or shock is contained within the step portion 2H by the step portion 2H, so that it is prevented that the valve body 3 is shifted from the water outlet 1B and water in the water outlet 1B leaks.

The valve body 3 has a disk shape. The valve body 3 is accommodated in the step portion 2H. The valve body 3 is pressed onto an end of the water outlet 1B by a compression screw 21 and the valve body 3 blocks the water outlet 1B.

The thermo-sensitive breakup portion 4 is engaged with the inward flange 2C (lever engaging portion 2F) formed on the beam-like portion 2J of the frame portion 2. When a fire occurs, the thermo-sensitive breakup portion 4 is activated to break up by heat of the fire and releases the valve body 3. The thermo-sensitive breakup portion 4 includes the lever 11, a support plate 12, a balancer 13, a cylinder 14, a plunger 15, a low melting point alloy 16, and a set screw 17.

Figure 4:
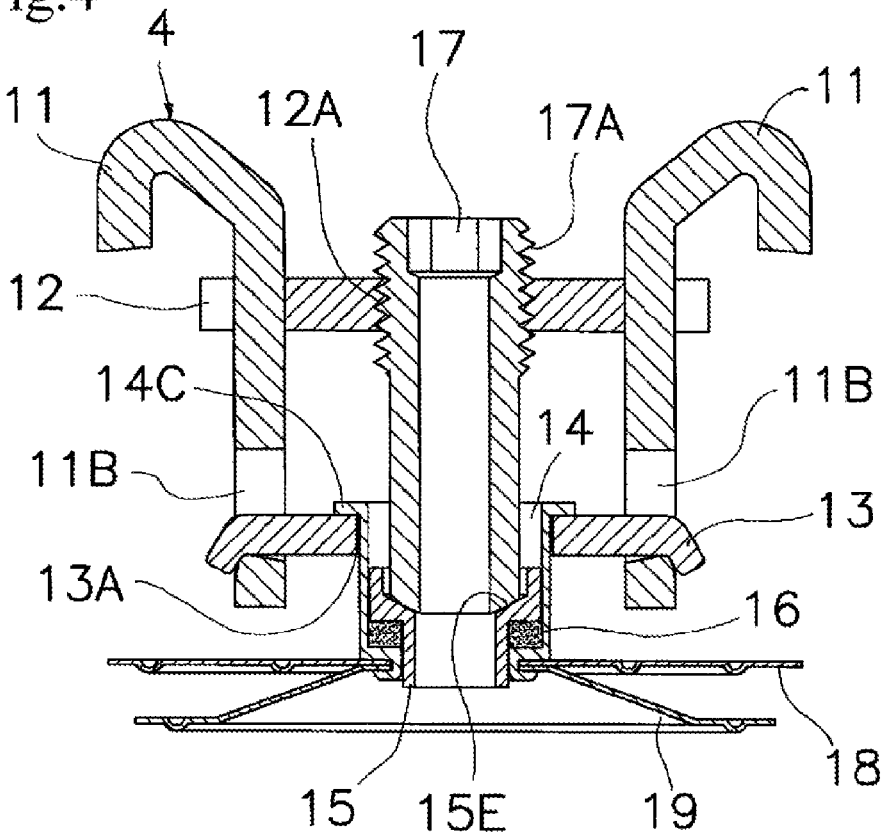
FIG. 4 is a cross-sectional view of a thermo-sensitive breakup portion.
Figure 5:
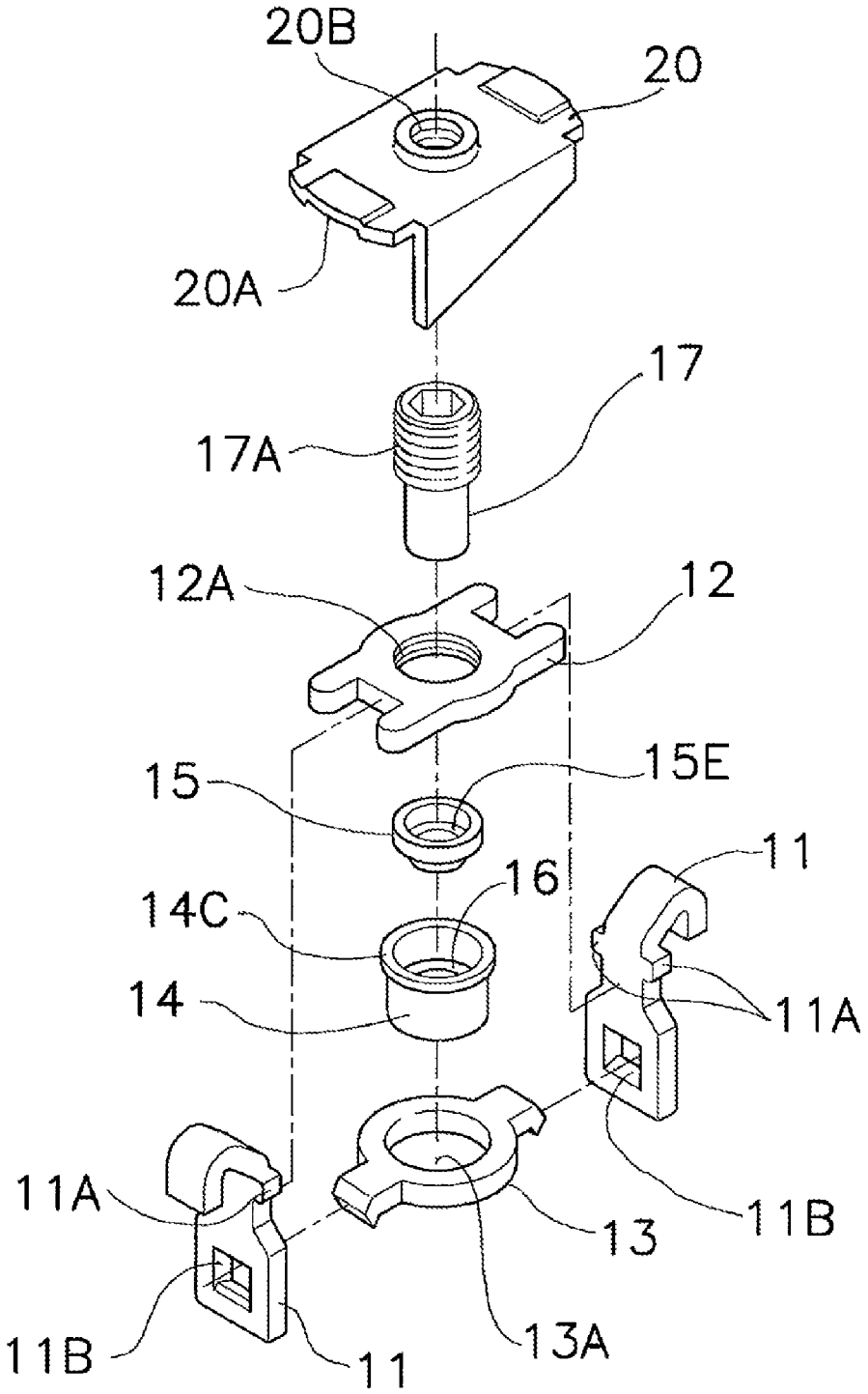
FIG. 5 is an exploded perspective view of the thermo-sensitive breakup portion.
Figure 6:
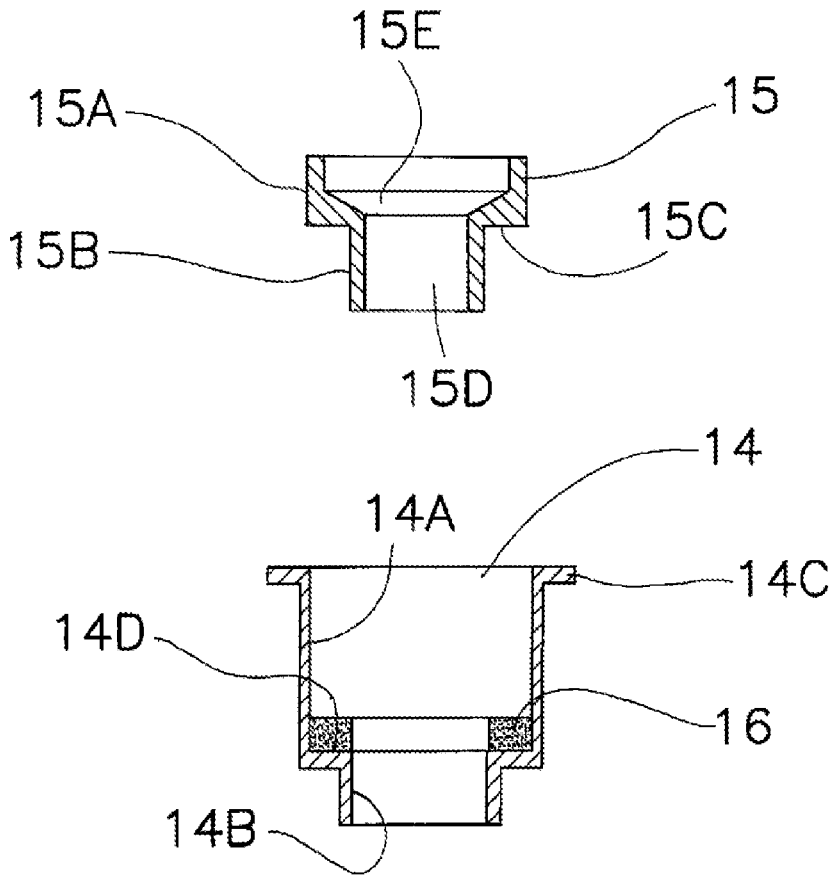
FIG. 6 is an exploded cross-sectional view of a cylinder/plunger.

The thermo-sensitive breakup portion 4 is formed as a unit component as shown in FIG. 4, and can be stored and transported as a unit component. When the sprinkler head is assembled, the thermo-sensitive breakup portion 4 is mounted in the main body 1 as a unit component shown in FIG. 4.

The levers 11 are used as a pair. One end of the lever 11 is engaged with the inward flange 2C and has a shape bending outward. Protrusions 11A, which are provided symmetrically, are formed at an upper portion of the lever 11 (FIG. 5), and a rectangular hole 11B is made in a lower portion of the lever 11. The support plate 12 and the balancer 13 are engaged between the pair of levers 11. The support plate 12 is engaged with the protrusions 11A and the balancer 13 is engaged with the lower holes 11B. A hole 13A is made in the center portion of the balancer 13, and the cylinder 14 is inserted into the hole 13A.

The cylinder 14 has a cylindrical shape. A step is formed inside the cylinder 14. A large diameter portion 14A and a small diameter portion 14B are formed in the cylinder 14. A circular ring-shaped low melting point alloy 16 is accommodated in the large diameter portion 14A. A flange portion 14C is formed on an end of the large diameter portion 14A and the flange portion 14C is engaged with the hole 13A of the balancer 13. The inside diameter of the small diameter portion 14B is substantially the same as the inside diameter of the ring-shaped low melting point alloy 16.

An end of the small diameter portion 14B is bent so that heat collectors 18 and 19 are sandwiched by the small diameter portion 14B and the heat collectors 18 and 19 are provided to the cylinder 14. The heat collectors 18 and 19 are formed of metal such as copper or copper alloy with good heat conductivity and have a function to absorb heat caused by a fire and transfer the heat to the low melting point alloy 16 in the cylinder 14.

A large diameter portion 15A and a small diameter portion 15B are formed on the outer circumference of the plunger 15 by a step. The outside diameter of the large diameter portion 15A is formed slightly smaller than the inside diameter of the large diameter portion 14A of the cylinder 14. The outside diameter of the small diameter portion 15B is formed slightly smaller than the inside diameter of the small diameter portion of the cylinder 14 and the inside diameter of the low melting point alloy 16.

The plunger 15 is inserted from the large diameter portion 14A of the cylinder 14, and the small diameter portion 15B and a step portion 15C between the large diameter portion 15A and the small diameter portion 15B come into contact with the low inciting point alloy 16. When the plunger 15 is inserted into the cylinder 14, the outer circumference surface of the plunger 15 is slidable on the inner circumference surfaces of the cylinder 14 and the low melting point alloy 16.

A through-hole 15D is made in the plunger 15 and a step portion 15E with which the tip of the set screw 17 comes into contact is formed at the middle of the through-hole 15D.

The set screw 17 has a cylindrical shape and a male screw 17A is formed on the outer circumference of the set screw 17. When the male screw 17A is threaded into a female screw 12A of the support plate 12, the tip of the set screw 17 presses the step portion 15E of the plunger 15, so that a compression force is applied to the low melting point alloy 16 by the step portion 15E of the plunger 15 and a bottom portion 14D of the cylinder 14.

Further, a force is applied to the support plate 12 and the balancer 13 which are engaged with the pair of levers 11 in a direction for strengthening engagement with the levers 11, and the engagement state of the levers 11, the support plate 12, and the balancer 13 is maintained. Thereby, the thermo-sensitive breakup portion 4 is formed as a unit.

A saddle 20 is placed between the thermo-sensitive breakup portion 4 and valve body 3. The saddle 20 is formed of a metal plate member. Concave portions 20A with which the pair of levers 11 engage are formed on a surface of the saddle 20. A female screw 20B is formed between the concave portions 20A and 20A, and the compression screw 21 is threaded into the female screw 20B. The compression screw 21 and the saddle 20 form a load generation member of the present invention.

When the compression screw 21 is threaded into the female screw 20B from the thermo-sensitive breakup portion 4 to the valve body 3, the tip of the compression screw 21 presses the valve body 3. Thereby, the valve body 3 is pressed to the end of the water outlet 1B and the valve body 3 blocks the water outlet 1B. At the same time, the pair of levers 11 downwardly press the inward flange 2C of the frame portion 2 with which the pair of levers 11 are engaged. Thereby, the beam-like portion 2J is elastically deformed and a slight displacement is generated. By the displacement caused by the deformation of the beam-like portion 2J, a spring force to explosively eject the components of the thermo-sensitive breakup portion 4 to the outside of the frame portion 2 is generated when the breakup action occurs. In the present embodiment, by a simple component configuration and a simple assembly operation of the compression screw 21 and the saddle 20, a load necessary for water block performance of the valve body 3 and deflective deformation of the beam-like portion 2J can be obtained.

The deflector 5 has a flat plate shape, and a plurality of slits 5A are formed around the deflector 5. Holes 5B and 5B, into which a guide pin 5C is fitted, are made in the deflector 5. One end of the guide pin 5C is inserted into the hole 5B and fixed by caulking. The guide pin 5C is inserted into a hole 5E made in the deflector engaging portion 2G of the main body 1. The guide pin 5C is slidable when the guide pin 5C is inserted into the hole 5E. A flange portion 5D is formed at the other end of the guide pin 5C, and the flange portion 5D can be engaged with the end surface of the of the hole 5E of the deflector engaging portion 2G of the main body 1.

The support cup 6 is a cylindrical member with a bottom portion, which covers the outside of the frame portion 2 of the main body 1. An opening 6B, into which the support cup engaging portion 1C of the main body 1 can be fitted, is formed in a bottom portion 6A of the support cup 6. The support cup engaging portion 1C is fitted into and the opening 6B, so that the support cup 9 is prevented from rotating with respect to the main body 1.

A cylindrical portion 6C, which is set upright to the outside, is formed on the circumferential portion of the opening 6B. The position of the end surface of the cylindrical portion 6C is nearer to the pipe connection portion 1A than the end surface of the support cup engaging portion 1C, and the end of the cylindrical portion 6C is located near a constricted portion 1D between the pipe connection portion 1A of the main body 1 and the support cup engaging portion 1C. A cut is made into a plurality of portions of the bottom of the cylindrical portion 6C, and then the upper portions of the cuts are pressed in a direction from the outer circumference to the constricted portion 1D, and the upper portions of the cuts are deformed toward the constricted portion 1D to form engaging portions 6D, so that the engaging portions 6D are engaged with the constricted portion 1D. Thereby, the support cup 6 can be fixed to the main body 1.

Base plates 6E, in which the same opening as the opening 6B is formed, are placed on the inner surface of the bottom of the support cup 6. A plurality of openings 6F are made at regular intervals near the outer circumference of the bottom surface 6A of the support cup 6. The opening 6F reaches from the bottom surface 6A to the side surface 6G of the support cup. A spiral groove 6H is formed on a portion of the side surface 6G near the end surface.

The cover plate 7 includes a cover 7A having a thin plate shape which covers over the main body 1, the thermo-sensitive breakup portion 4, and the deflector 5 in the support cup 6 and a retainer 7B having a cylindrical shape. The cover plate 7 is connected to the support cup 6 after the pipe connection portion 1A of the main body 1 is connected to a fire extinguishing system pipe, so that the cover plate 7 is assembled as a separate component from the main body 1 and the support cup 6.

The cover 7A has a disk shape and is made of a material such as copper and copper alloy that easily transfer heat. The retainer 7B has a cylindrical shape. The tip portions of a plurality of legs downwardly extending from the lower end of the retainer 7B are bent to form connection surfaces 7C connected to the cover 7A. The connection surface 7C is connected to the cover 7A by a low melting point alloy 7D. The low melting point alloy 7D has a melting point lower than that of the low melting point alloy 16 in the cylinder 14.

A protrusion 7E, which can be screwed with the spiral groove 6H of the support cup 6, is formed on the circumferential surface of the retainer 7B. The protrusion 7E is formed so that the protrusion 7E protrudes obliquely downward by making a cut in the circumferential surface of the retainer 7B. The protrusion 7E has a function of a stopper, and if trying to pull the retainer 7B out downward when the retainer 7B is screwed with the spiral groove 6H of the support cup 6, the protrusion 7E is caught by the spiral groove 6H, so that the retainer 7B is prevented from being pulled out.

On the other hand, when fitting the retainer 7B into the support cup 6, the protrusion 7E is elastically deformed on the spiral groove 6H, so that the protrusion 7E can pass through over the spiral groove 6H. Therefore, when fitting the retainer 7B into the support cup 6, the retainer 7B can be fitted by one-push operation to push the retainer 7B into the support cup 6.

Next, an assembly procedure and a formation procedure of the sprinkler head of the first embodiment will be described.

First, the valve body 3 is fitted into the step portion 2H from the end of the frame portion 2 of the main body 1. Next, the saddle 20 with which the compression screw 21 is screwed is put into the frame portion 2.

Further, the preassembled thermo-sensitive breakup portion 4 in a state shown in FIG. 4 is inserted into the frame portion 2 so that the levers 11 are engaged with the positions of the concave portions 20A of the saddle 20. At this time, the levers 11 are inserted into the frame portion 2 by causing the levers 11 to pass through the lever insertion grooves 2D on the inward flanges 2C, and the tips of the levers 11 are inserted behind the inward flanges 2C. Thereafter, the thermo-sensitive breakup portion 4 is rotated and the concave portions 20A are engaged with the levers 11. The thermo-sensitive breakup portion 4 is further rotated, and the levers 11 are set at positions rotated substantially 90° from the lever insertion grooves 2D.

Next, a tool such as a wrench or a screwdriver that can rotate the compression screw 21 is inserted from a through-hole of the set screw 17 of the thermo-sensitive breakup portion 4 and the compression screw 21 is screwed with the female screw 20B. Then the tip of the compression screw 21 presses the valve body 3, and the tips of the levers 11 press the inward flanges 2C and elastically deform the inward flanges 2C. The compression screw 21 is tightened by a predetermined torque, so that it is possible to control a load by which the valve body 3 presses the water outlet 1B within a predetermined range. In this way, the assembly operation is completed by inserting a tool into the through-hole and screwing the compression screw 21 with the female screw 20B after all the components such as the valve body 3 are put into the frame portion 2, so that the assembly operation can be easily performed.

Next, the deflector 5 is placed in the main body 1. The guide pins 5C are inserted into the holes 5E made in the deflector engaging portions 2G of the main body 1, and then the tips of the guide pins 5C are fixed to the holes 5B of the deflector 5 by caulking.

Next, the support cup 6 is placed in the main body 1. In a state in which the support cup engaging portion 1C of the main body 1 and the cylindrical portion 6C of the support cup 6 are fitted together, a cut is made into a plurality of portions of the bottom of the cylindrical portion 6C. Thereafter, when upper portions of the cuts are pressed in a direction from the outer circumference of the cylindrical portion 6C to the constricted portion 1D, the upper portions of the cuts are deformed along the outer circumferential shape of the constricted portion 1D to form the engaging portions 6D. The engaging portions 6D and the constricted portion 1D are engaged together, so that the fixation of the support cup 6 to the main body 1 is completed. Here, the assembly procedure of the sprinkler head as a product has been completed.

Figure 7:
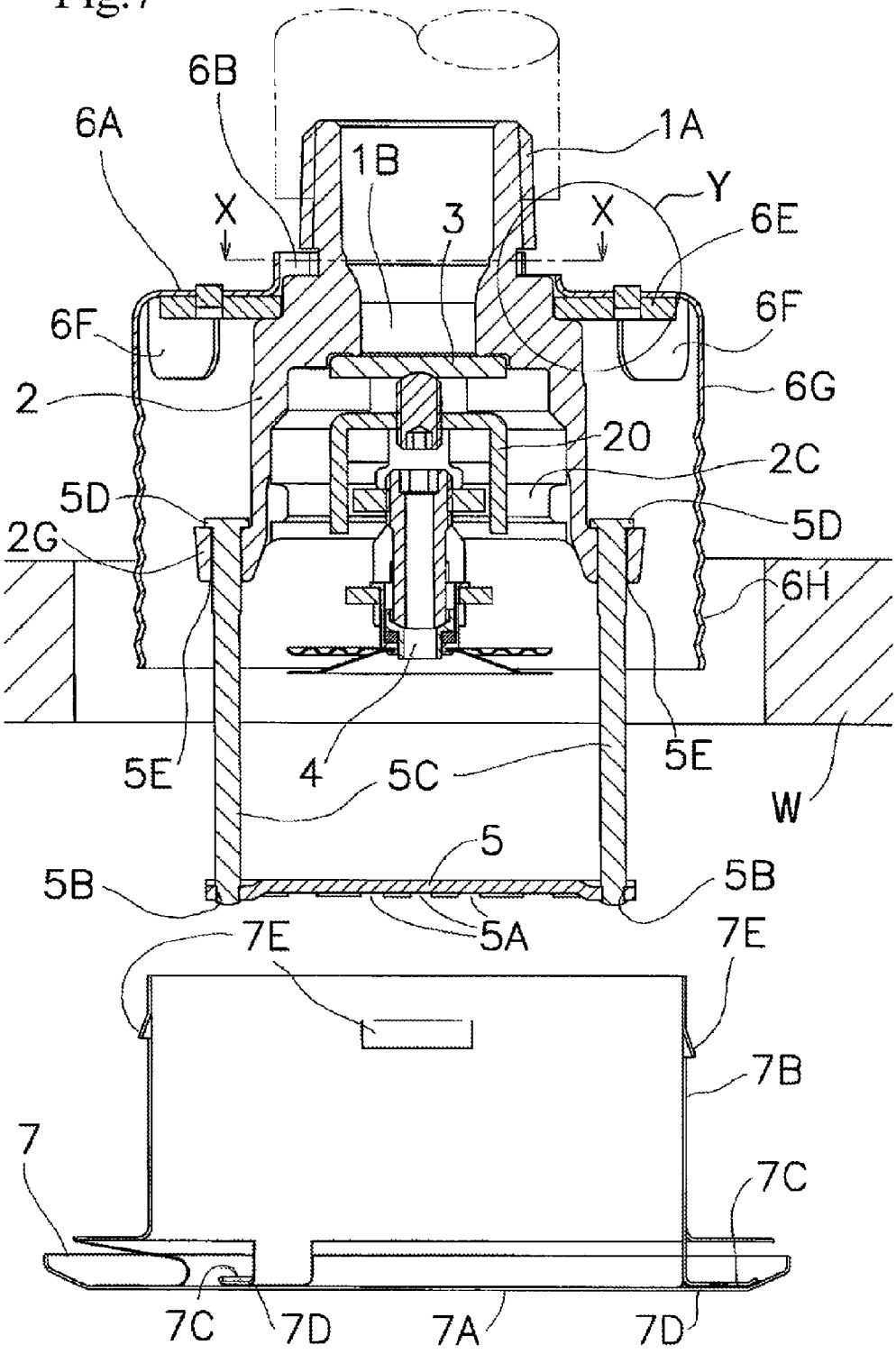
FIG. 7 is a cross-sectional view of the sprinkler head of FIG. 1 when the sprinkler head is installed.
Figure 8:
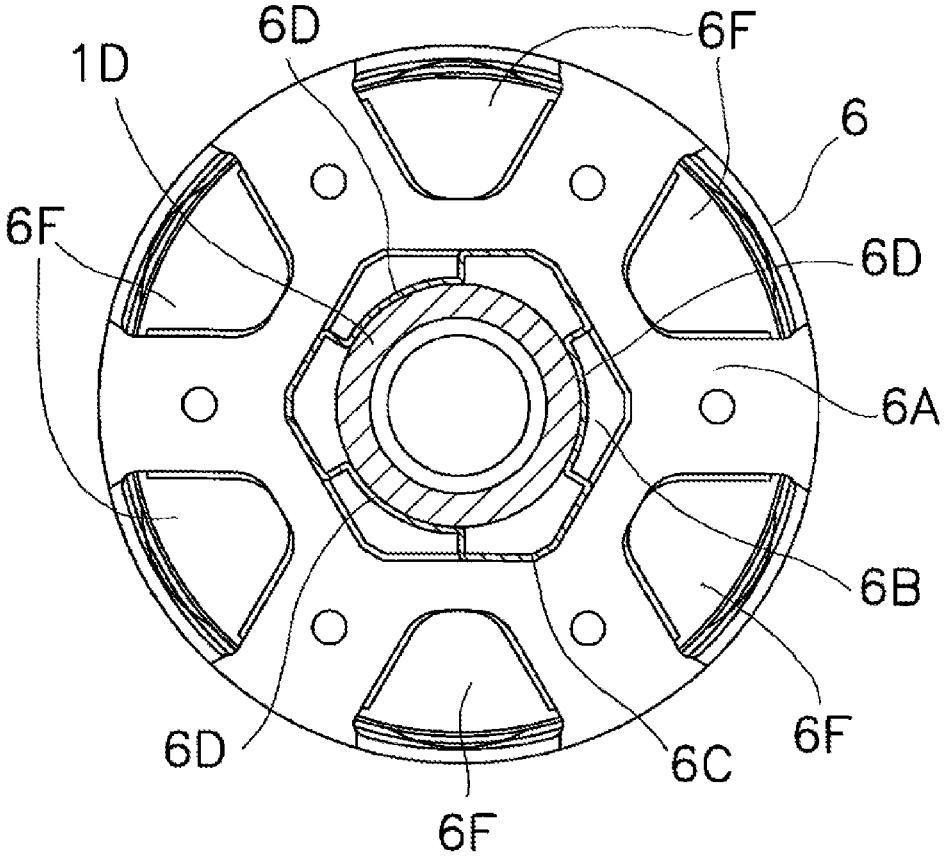
FIG. 8 is a cross-sectional view taken along line X-X in FIG. 7.
Figure 9:
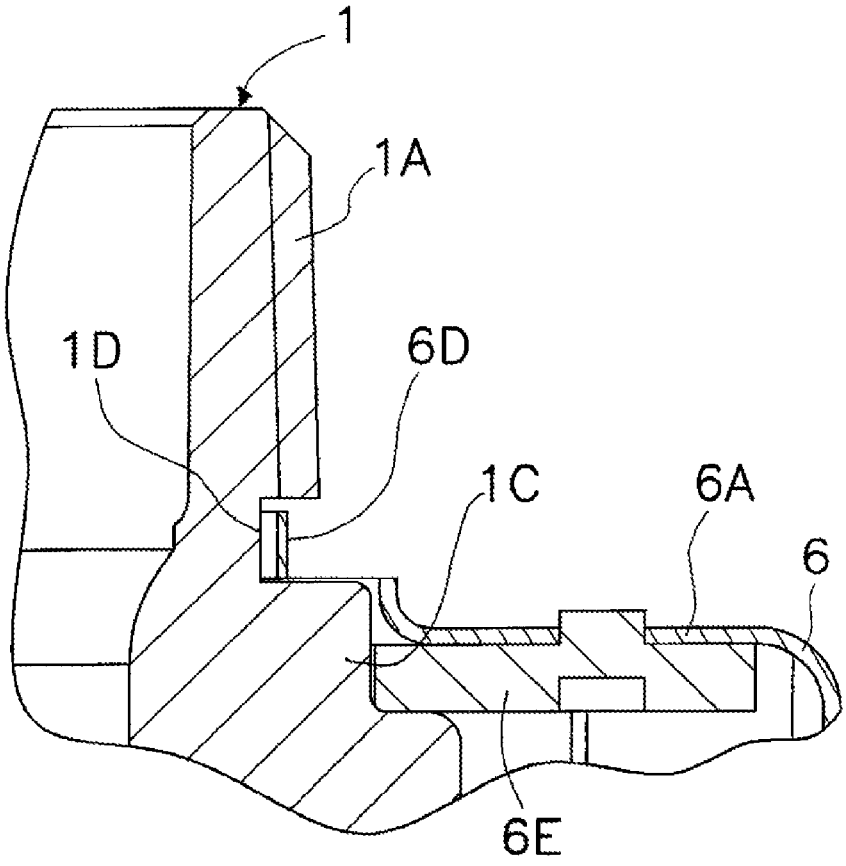
FIG. 9 is an enlarged diagram of a portion indicated by Y in FIG. 7.

The cover plate 7 is connected to the support cup 6 after the product described above is connected to a pipe and attached to a ceiling board W (a state shown in FIG. 7). The cover plate 7 is placed by screwing the protrusion 7E of the cover plate 7 with the spiral groove 6H of the support cup 6.

At this time, the distance between the connection port of the fire extinguishing system pipe and the ceiling surface may be different for each connection port of the fire extinguishing system pipe depending on the design and the construction process. In this case, it is possible to place the cover plate 7 in accordance with the distance between each connection port and the ceiling surface by adjusting the insertion length of the retainer 7B in the support cup 6.

For example, when the retainer 7B is inserted into the deepest position of the support cup 6, but the distance between the connection port of the pipe and the ceiling surface is larger than that shown in FIG. 1, the insertion length of the retainer 7B may be shortened.

In this case, in the present embodiment, the deflector engaging portions 2G are provided at the opening of the frame portion 2 nearest possible to the ceiling surface, so that the movement range of the deflector 5 is large. Therefore, even when the insertion length of the retainer 7B is small and the deflector 5 is placed on the back surface of the cover plate 7 at a position lower than that shown in FIG. 1, the installation can be performed without problem. In other words, the adjustment margin of the installation of a concealed type sprinkler head A can be large, so that the installation is easy.

By the above operation, the assembly of the sprinkler head shown in FIG. 1 is completed.

Next, the functions and the effects of the sprinkler head A of the first embodiment will be described.

The outer circumferential surface protruding to the outside of the pipe connection portion 1A is formed on the frame portion 2 and the frame portion 2 includes the beam-like portions 2J (inward flanges 2C) with which the lever 11 of the thermo-sensitive breakup portion 4 engages and the openings 2E obtained by cutting off the outer circumferential surface from the side of the pipe connection portion 1A to the beam-like portion 2J at opposite positions in the outer circumferential surface, so that the weight of the frame portion 2 can be largely reduced. Therefore, the load applied to the fire extinguishing system pipe can be reduced, and the work burden due to the weight load when the sprinkler heads are conveyed and installed in the fire extinguishing system pipes can also be reduced.

The beam-like portions 2J are formed at positions opposite to each other in the frame 2, so that the press loads of the levers 11 of the thermo-sensitive breakup portion 4 can be equally applied to both beam-like portions 2J, and the spring forces caused by deflection of the beam-like portions 2J can be equally exerted. Therefore, the thermo-sensitive breakup portion 4 can be continuously and stably maintained over a number of years. The equal spring forces caused by deflection of the beam-like portions 2J can explosively eject the components of the thermo-sensitive breakup portion 4 in the axis direction of the frame portion 2 when the thermo-sensitive breakup portion 4 is activated to break up, so that the equal spring forces can function to prevent the lodgment from occurring.

The opening end, from which the thermo-sensitive breakup portion 4 is inserted, is formed in the frame portion 2. Therefore, the thermo-sensitive breakup portion 4 can be inserted from the opening end of the frame portion 2, so that the thermo-sensitive breakup portion 4 can be easily installed. The thermo-sensitive breakup portion 4 of the present embodiment is a unit component, so that it is not necessary to assemble the thermo-sensitive breakup portion 4 while the thermo-sensitive breakup portion 4 is being installed inside the frame portion 2. Therefore, the assembly operation can be simplified.

The openings 2E of the frame portion 2 are provided at a position near the central axis of the frame 2, which is inner than the outer circumferential surfaces of the beam-like portions 2J. Thereby, the openings 2E can be formed at the same time when the cutting operation of the inner circumferential surfaces of the beam-like portions 2J is performed. Therefore, it is possible to reduce the manufacturing cost for forming the openings 2E and providing the beam-like portions 2J without depending on a dedicated process for forming the openings 2E.

In the present embodiment, the pipe connection portion 1A and the frame portion 2 are a forged body having an integrated structure, so that the number of components can be reduced compared with a case in which these portions are separate components. Therefore, it is possible to reduce the cost.

The lever insertion groove 2D, into which the lever 11 of the thermo-sensitive breakup portion 4 is inserted, is formed in the inward flange 2C, so that, when the thermo-sensitive breakup portion 4 is inserted into the frame portion 2, the lever insertion groove 2D does not interfere with the thermo-sensitive breakup portion 4. Therefore, the thermo-sensitive breakup portion 4 can be easily inserted with good operability.

In the thermo-sensitive breakup portion 4, the lever 11 is inserted into the lever insertion groove 2D, and then rotated around the axis of the frame portion 2, so that the lever 11 is engaged with the inward flange 2C. Thereby, the assembly operation can be easily performed.

In the present embodiment, the deflector 5 is provided outside the opening end of the frame portion 2. Therefore, the deflector 5 can have various shapes according to the specification and usage of the sprinkler head to be attached to the sprinkler head, so that different products can be easily formed. In other words, the product before attaching the deflector 5 can be commonly used for various products, and products of different specifications can be easily made by attaching the deflector 5 according to the specification and usage of a desired sprinkler head.

In the present embodiment, the deflector engaging portion 2G is provided on the outer circumferential surface of the frame 2 in a direction outward of the lever insertion groove 2D. Thereby, the position of the lever 11 of the thermo-sensitive breakup portion 4 is separated from the deflector engaging portion 2G, so that the lodgment can be effectively prevented when the thermo-sensitive breakup portion 4 is activated to break up. In other words, the lever insertion groove 2D is located on the inner circumferential surface of the frame portion 2 at which the deflector engaging portion 2G is provided. Thereby, the lever 11 of the thermo-sensitive breakup portion 4 cannot engage at the position of the inner circumferential surface of the deflector engaging portion 2G. Therefore, the lever 11 has to engage with the inward flange 2C located away from the deflector engaging portion 2G. Thereby, it is possible to prevent the lever 11 from hitting the guide pin 5C when the thermo-sensitive breakup portion 4 is activated to break up and lever 11 flies and drops when the sprinkler head A is activated, so that the lodgment can be prevented when the thermo-sensitive breakup portion 4 is activated to break up.

Second Embodiment

FIG. 10

Next, a second embodiment of the present invention will be described with reference to FIG. 10.

Figure 10:
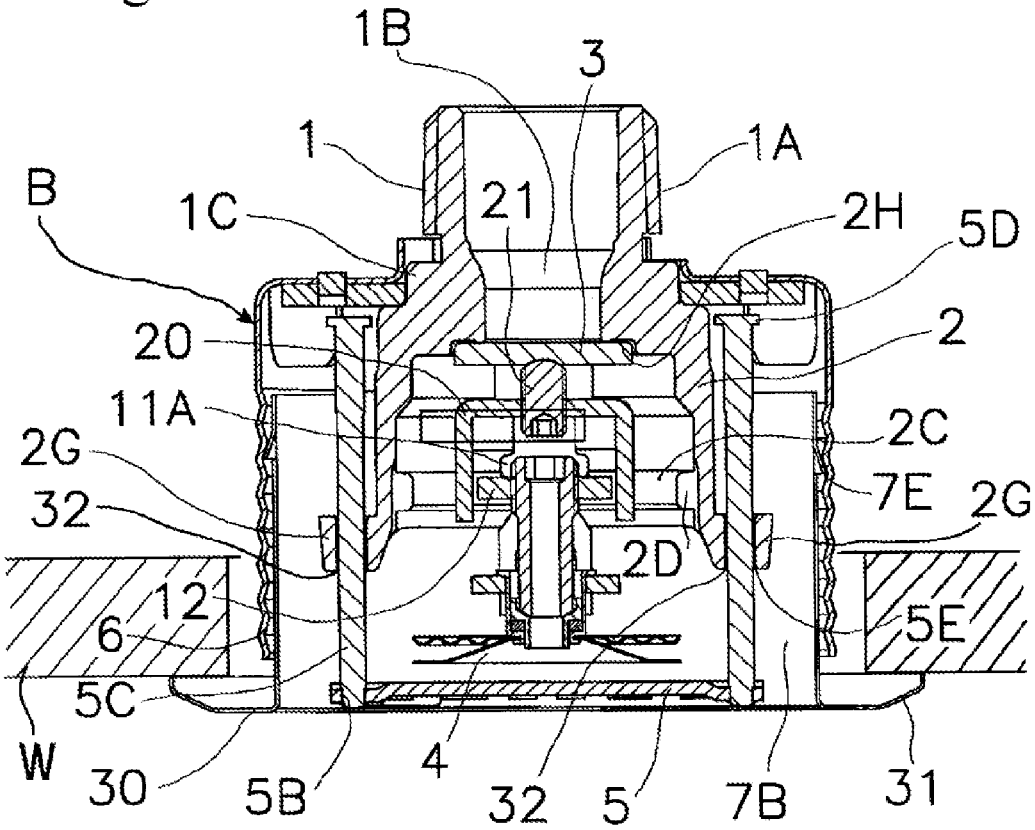
FIG. 10 is a cross-sectional view of a sprinkler head according to a second embodiment.

A sprinkler head B of the second embodiment shown in FIG. 10 is a flush type sprinkler head. In the second embodiment, the same components as those in the first embodiment are denoted by the same reference signs and detailed description will be omitted.

The difference between the second embodiment and the first embodiment will be described. In the second embodiment, the cover plate 7 of the first embodiment is replaced by a ceiling plate 30. In the same manner as the cover plate 7, the ceiling plate 30 has the retainer 7B that can be connected to the spiral groove 611 of the support cup 6. The lower end of the retainer 7B is extended in a flange shape and a plate 31 is formed. The plate 31 has a function to cover over the hole of the ceiling board W.

In FIG. 10, the deflector 5 is exposed from the lower surface (facing the room) of the ceiling board W. Surface treatment such as painting may be performed on the deflector 5 and the plate 31 in accordance with the color of the ceiling board W. The guide pin 5C and the hole 5E of the deflector engaging portion 2G are connected together by a low melting point alloy 32 in order to place the deflector 5 so that the deflector 5 does not protrude from the ceiling board W. The low melting point alloy 32 has a melting point lower than that of the low melting point alloy 16 used in the thermo-sensitive breakup portion 4.

According to the sprinkler head B of the second embodiment, the same functions and effects as those of the sprinkler head A of the first embodiment can be obtained. Further, the deflector 5 is normally placed so as not to protrude from the ceiling board W, so that the sprinkler head can be installed without spoiling the beauty of the room.

Third Embodiment

FIG. 11

Next, a third embodiment of the present invention will be described with reference to FIG. 11.

Figure 11:
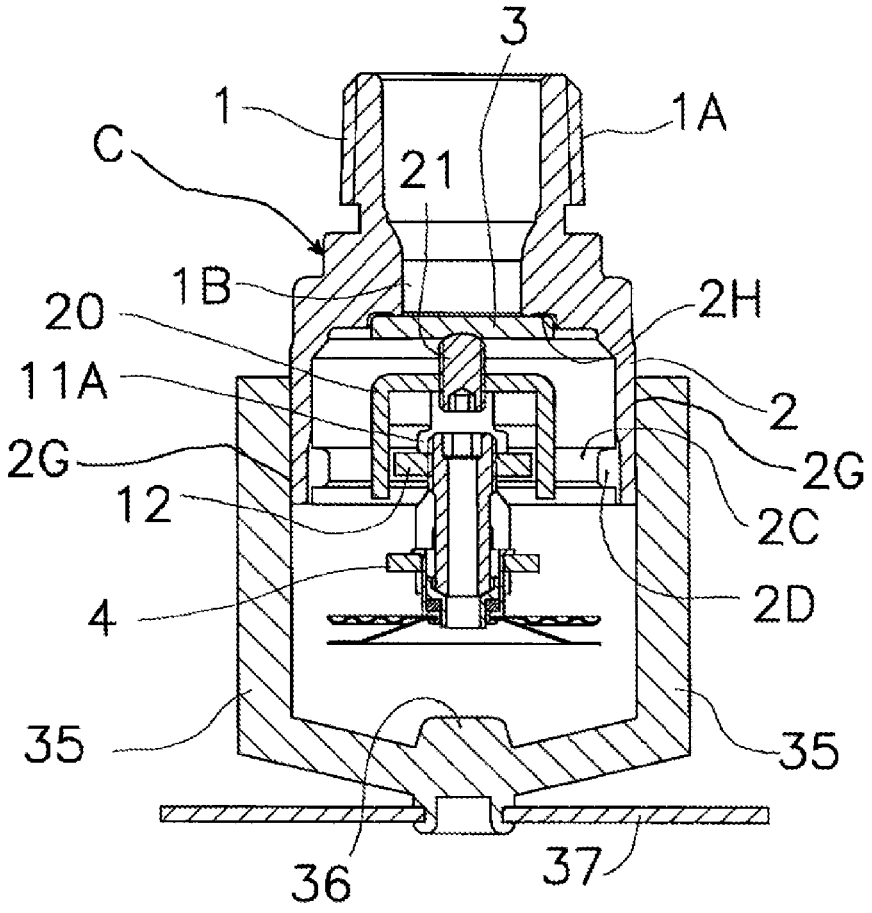
FIG. 11 is a cross-sectional view of a sprinkler head according to a third embodiment.

A sprinkler head C of the third embodiment shown in FIG. 11 is a frame yoke type sprinkler head. In the third embodiment, the same components as those in the first embodiment are denoted by the same reference signs and detailed description will be omitted.

The difference between the third embodiment and the first embodiment will be described. In the third embodiment, U-shaped arms 35 and 35 are connected to the frame portion 2 as deflector engaging portions. The ends of the arms 35 and 35 are connected together at a position extended from the water outlet 1B, and a boss portion 36 protruding toward the water outlet 1B is formed at the connection portion. A plate-shaped deflector 37 is fixed to the opposite side of the boss portion 36. Although not shown in FIG. 11, the arms 35 and 35 are attached to the frame portion 2 by a method such as screwing, welding, and brazing.

According to the third embodiment, it is possible to mount the thermo-sensitive breakup portion 4 in the main body 1, and thereafter attach the arms 35 to the frame portion 2 and attach the deflector 37 to the tips of the arms 35. Therefore, many types of products can be made by attaching the deflectors 37 having a shape in accordance with a desired specification and usage. If the arms 35 have strength capable of supporting the water flow discharged from the water outlet 1B by the deflector 37, the arms 35 can be formed by pins or thin plates. When the arms 35 are formed by pins or thin plates, the arms 35 can be configured so as not to interfere with the water flow discharged from the water outlet 1B.

Modified Examples of the Embodiments

FIG. 12

Figure 12:
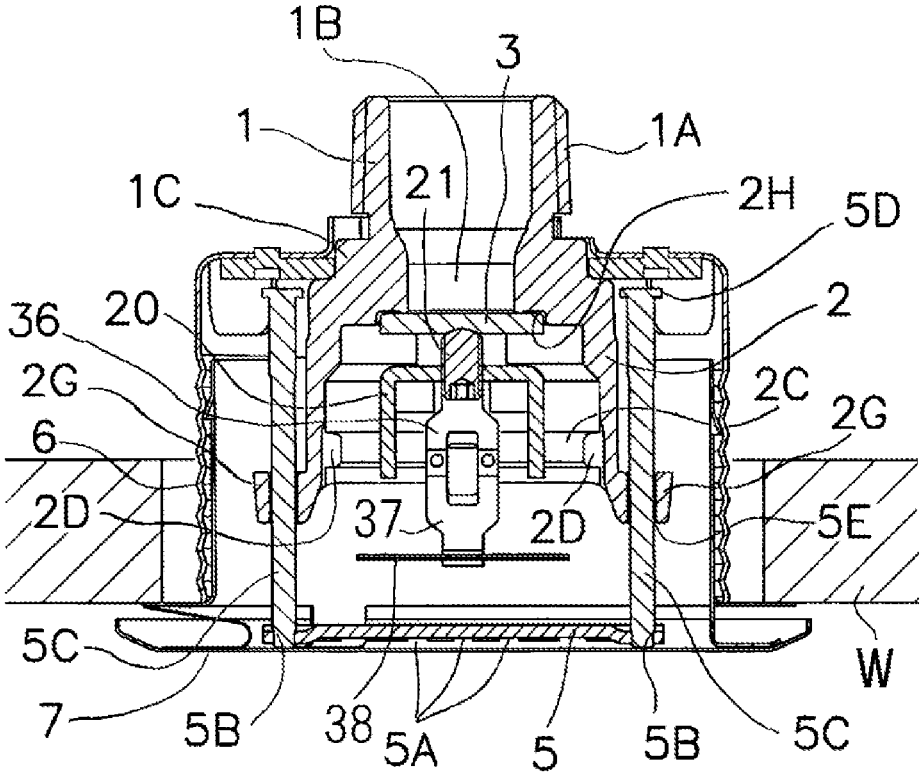
FIG. 12 is a cross-sectional view of a sprinkler head according to a modified example of the embodiments.
Figure 13:
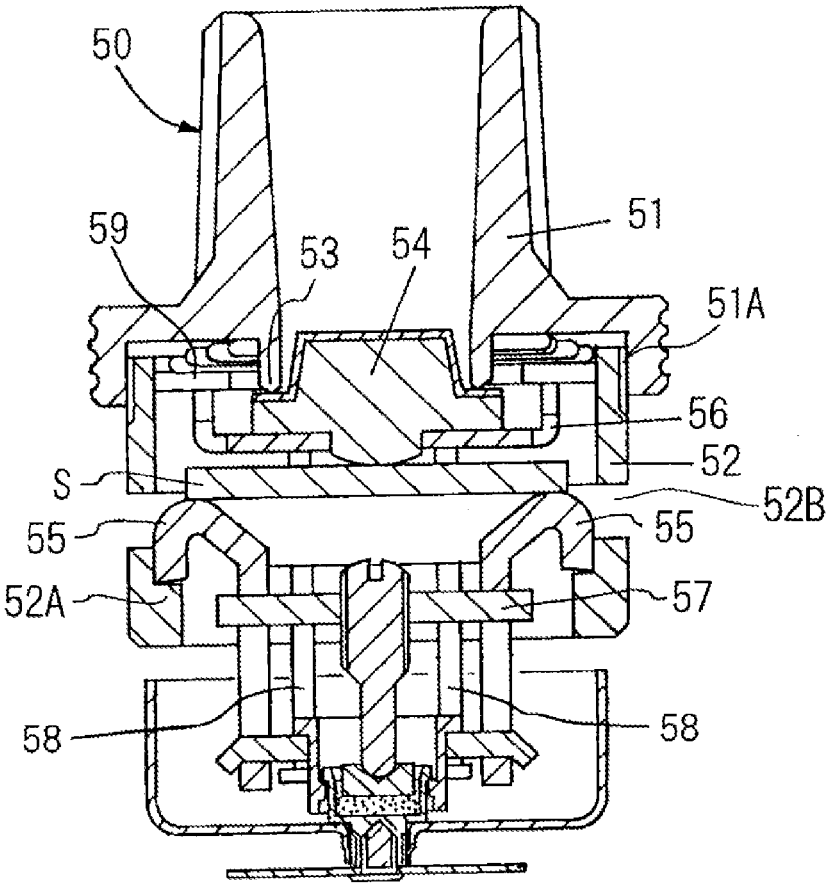
FIG. 13 is a cross-sectional view of a conventional sprinkler head.

Instead of the thermo-sensitive breakup portion 4 of the first to the third embodiments, it is possible to use a thermo-sensitive breakup portion including a link in which two thin plates are connected together by a low melting point alloy and a pair of levers with which the link is engaged (see Japanese Unexamined Patent Application Publication No. 2008-154697). FIG. 12 shows a modified example of the first embodiment, which uses such a thermo-sensitive breakup portion 36. The thermo-sensitive breakup portion 36 can be mounted on the lever engaging portion 2F of the frame portion 2 while one end of the lever 37 is engaged with the inward flange 2C (lever engaging portion 2F) and the other end is engaged with a link 38.

Although, in the first embodiment, an example is described in which the components are mounted in the frame portion 2 after the compression screw 21 is screwed with the female screw 20B of the saddle 20, it is possible to employ a configuration in which the compression screw 21 is not screwed with the saddle 20 in advance and the compression screw 21 is inserted through the through-hole of the set screw 17 of the thermo-sensitive breakup portion 4 to be engaged with the female screw 20B of the saddle 20 after predetermined components are mounted in the frame portion 2.

Although the arms 35 of the third embodiment are illustrated as components separate from the frame portion 2, a frame portion 2 in which the arms 35 are integrally formed with a part of the frame portion 2 can be used.

REFERENCE SIGNS LIST

A sprinkler head (first embodiment)
B sprinkler head (second embodiment)
C sprinkler head (third embodiment)
1 main body
1A pipe connection portion
1B water outlet
2 frame portion
2B planar surface portion
2C inward flange
2D lever insertion groove
2E opening (opening portion)
2F lever engaging portion
2G deflector engaging portion
2H step portion
2J beam-like portion
3 valve body
4 thermo-sensitive breakup portion
5, 37 deflector
6 support cup
7 cover plate 7
11 lever
12 support plate
13 balancer
14 cylinder
15 plunger
16, 32 low melting point alloy
17 set screw
20 saddle
21 compression screw
30 ceiling plate
35 arm (deflector engaging portion)
36 thermo-sensitive breakup portion
37 lever
38 link

The invention claimed is:

1. A sprinkler head characterized by comprising:

a pipe connection portion, one end of which is connected to a fire extinguishing system pipe and the other end of which has a water outlet;

a cylindrical frame portion, one end of which is connected to the water outlet and the other end of which has an opening end; and a thermo-sensitive breakup portion which holds a pressing force of a valve body closing the water outlet and has a lever to which a reaction force of the pressing force is applied, wherein the frame portion has a cylindrical wall having an outer circumferential surface protruding outside of the pipe connection portion, and the outer circumferential surface has a curved surface portion, the beam-like portions with which the lever is engaged and having a same radius as the curved surface portions, a planar surface portion formed as a cut-off surface portion, opening portions arranged between the planar surface portion and the beam-like portions.

2. The sprinkler head according to claim 1, wherein the opening portion is provided at an inner position nearer to a central axis of the frame portion than an outer circumferential surface of the beam-like portion.

3. The sprinkler head according to claim 1, wherein the pipe connection portion and the frame portion are a forged body having an integrated structure.

4. The sprinkler head according to claim 1, wherein the thermo-sensitive breakup portion is a unit component in which a plurality of components are combined.

5. The sprinkler head according to claim 1, wherein a lever engaging portion engaged with the lever of the thermo-sensitive breakup portion is provided on an inner circumferential surface of the beam-like portion.

6. The sprinkler head according to claim 1, wherein a lever insertion groove that causes the lever of the thermo-sensitive breakup portion to be inserted in the frame portion is provided on an inner circumferential surface of the frame portion.

7. The sprinkler head according to claim 1, wherein a deflector is provided outside of the opening end of the frame portion.

8. The sprinkler head according to claim 1, wherein a deflector engaging portion that holds a deflector is provided on the outer circumferential surface of the frame portion.

9. The sprinkler head according to claim 1, further comprising:

a guide pin, one end of which is provided with a deflector and the other end of which is engaged with a deflector engaging portion provided on the frame portion.

10. The sprinkler head according to claim 8, wherein the deflector engaging portion is provided on the outer circumferential surface of the frame portion in an outward position of a lever insertion groove.

11. The sprinkler head according to claim 8, wherein the deflector engaging portion is provided nearer the opening end of the frame portion than the lever engaging portion.

12. The sprinkler head according to claim 1, further comprising:

a load generation member which is placed between the valve body and the thermo-sensitive breakup portion, urges the valve body and the lever of the thermo-sensitive breakup portion engaged with the beam-like portion in opposite directions from each other, and generates a press load for the valve body to block the water outlet.

13. The sprinkler head according to claim 12, further comprising:

as the load generation member, a saddle which includes a compression screw pressing the valve body to the water outlet and a female screw that can be screwed with the compression screw, urges the thermo-sensitive breakup portion in a direction opposite to the pressing direction of the valve body to the water outlet by screwing the compression screw with the female screw, and engages the lever of the thermo-sensitive breakup portion with the beam-like portion in a pressing state.

14. The sprinkler head according to claim 13, wherein a through-hole is provided in the thermo-sensitive breakup portion and an amount of screwing of the compression screw with the female screw of the saddle can be adjusted by a tool inserted into the through-hole.

15. The sprinkler head according to claim 1, wherein a support cup having a cylindrical shape and a bottom portion, which accommodates the frame portion, is provided in a main body including the pipe connection portion and the frame portion.

16. The sprinkler head according to claim 15, wherein the main body and the support cup are connected to each other by a polygonal connection portion.

17. The sprinkler head according to claim 1, further comprising:

a cover plate that covers over the sprinkler head installed in an opening in a ceiling so that the sprinkler head is not exposed to the outside and a cylindrical retainer that holds the cover plate as well as the support cup.

18. The sprinkler head according to claim 1, further comprising:

a ceiling plate that covers over a boundary between an outer circumferential surface of the sprinkler head installed in an opening in a ceiling and an edge of the opening and a cylindrical retainer that holds the ceiling plate as well as the support cup.

19. The sprinkler head according to claim 1, further comprising:

a cross-sectional U-shaped arm including an attaching portion for the outer circumferential surface of the frame portion at the upper end thereof and a deflector at the lower end thereof.

20. The sprinkler head according to claim 1, wherein the planar surface portion has a smaller radius than the beam-like portions.

* * * * *